US010933268B2

(12) United States Patent
Huotari

(10) Patent No.: US 10,933,268 B2
(45) Date of Patent: Mar. 2, 2021

(54) SUPPRESSION UNIT AND METHOD

(71) Applicants: Marioff Corporation Oy, Vantaa (FI); Arto Huotari, Helsinki (FI)

(72) Inventor: Arto Huotari, Helsinki (FI)

(73) Assignee: MARIOFF CORPORATION OY, Vantaa (FI)

( * ) Notice: Subject to any disclaimer, the term of this patent is extended or adjusted under 35 U.S.C. 154(b) by 195 days.

(21) Appl. No.: 15/765,772

(22) PCT Filed: Oct. 6, 2015

(86) PCT No.: PCT/FI2015/050669
§ 371 (c)(1),
(2) Date: Apr. 4, 2018

(87) PCT Pub. No.: WO2017/060557
PCT Pub. Date: Apr. 13, 2017

(65) Prior Publication Data

US 2018/0296867 A1 Oct. 18, 2018

(51) Int. Cl.
*A62C 37/09* (2006.01)

(52) U.S. Cl.
CPC ..... *A62C 37/09* (2013.01)

(58) Field of Classification Search
CPC ..... B05B 15/40; B05B 1/14; A62C 37/09; A62C 31/005
USPC ..... 169/37
See application file for complete search history.

(56) References Cited

U.S. PATENT DOCUMENTS

| | | | | |
|---|---|---|---|---|
| 2,009,478 A | | 7/1935 | Coles et al. | |
| 2,051,287 A | | 7/1935 | Buckner | |
| 2,221,878 A | | 11/1940 | Nelson | |
| 2,493,982 A | | 1/1950 | Lee | |
| 3,291,216 A | * | 12/1966 | Merrill | A62C 37/12 169/39 |
| 3,464,628 A | | 9/1969 | Chow | |

(Continued)

FOREIGN PATENT DOCUMENTS

| | | |
|---|---|---|
| CN | 1243446 A | 2/2000 |
| CN | 2865861 Y | 2/2007 |

(Continued)

OTHER PUBLICATIONS

Chinese First Office Action for application CN 2020030201791870, dated Mar. 5, 2020, 20 pages.

(Continued)

*Primary Examiner* — Chee-Chong Lee
(74) *Attorney, Agent, or Firm* — Cantor Colburn LLP

(57) ABSTRACT

A suppression unit includes a nozzle, a casing, and a biasing device. The nozzle includes an exterior surface, an interior bore extending along a longitudinal axis, and a plurality of discharge orifices passing from the interior bore to the exterior surface. The casing includes an interior surface and an exterior surface. The nozzle is disposed within the casing. The discharge orifices are covered by the casing in a biased passive condition of the nozzle, and the discharge orifices are moved longitudinally out of the casing in an active condition of the nozzle. The biasing device is disposed in a spring chamber between the nozzle and the casing. The spring chamber is fluidically isolated from the nozzle in the active and passive conditions.

13 Claims, 8 Drawing Sheets

(56) References Cited

U.S. PATENT DOCUMENTS

| | | | | |
|---|---|---|---|---|
| 3,521,822 | A | 7/1970 | Friedmann et al. | |
| 3,526,363 | A | 9/1970 | Hauser | |
| 3,655,132 | A | 4/1972 | Rosic | |
| 3,848,675 | A | 11/1974 | Evans | |
| 3,940,066 | A | 2/1976 | Hunter | |
| 4,015,665 | A * | 4/1977 | Simons | A63C 37/09 169/40 |
| 4,214,631 | A * | 7/1980 | Hattori | A62C 37/12 169/40 |
| 4,253,608 | A | 3/1981 | Hunter | |
| 4,625,914 | A | 12/1986 | Sexton et al. | |
| 4,634,052 | A | 1/1987 | Grizzle et al. | |
| 4,977,963 | A | 12/1990 | Simons | |
| 4,986,474 | A | 1/1991 | Schisler et al. | |
| 5,058,806 | A | 10/1991 | Rupar | |
| 5,292,071 | A | 3/1994 | Kruer | |
| 6,000,632 | A | 12/1999 | Wallace | |
| 6,651,905 | B2 | 11/2003 | Sesser et al. | |
| 6,732,950 | B2 | 5/2004 | Ingham, Jr. et al. | |
| 7,040,259 | B2 | 5/2006 | Sundholm | |
| 7,146,938 | B2 | 12/2006 | Sundholm | |
| 7,516,800 | B1 | 4/2009 | Silva, Jr. et al. | |
| 7,644,870 | B2 * | 1/2010 | Alexander | B05B 15/50 239/1 |
| 7,686,236 | B2 | 3/2010 | Alexander | |
| 8,181,889 | B2 | 5/2012 | Shahak | |
| 8,225,881 | B2 | 7/2012 | Silva, Jr. | |
| 8,528,653 | B1 | 9/2013 | Silva, Jr. et al. | |
| 2005/0224240 | A1 * | 10/2005 | Cosgrove | A62C 37/09 169/56 |
| 2008/0060216 | A1 * | 3/2008 | Reilly | F26B 5/04 34/413 |
| 2012/0285707 | A1 * | 11/2012 | Kameishi | A62C 37/12 169/39 |
| 2013/0068848 | A1 * | 3/2013 | Schultheis | B05B 15/70 239/1 |
| 2018/0280745 | A1 | 10/2018 | Huotari | |

FOREIGN PATENT DOCUMENTS

| | | | |
|---|---|---|---|
| CN | 101822882 | A | 9/2010 |
| CN | 201823211 | U | 5/2011 |
| CN | 102240428 | A | 11/2011 |
| CN | 102441246 | B | 5/2012 |
| CN | 103071268 | A | 5/2013 |
| KR | 20110009907 | A | 1/2011 |
| KR | 101516282 | | 5/2015 |
| KR | 101533759 | | 7/2015 |
| RU | 2015737 | C1 | 7/1994 |
| WO | 2005102461 | A1 | 11/2005 |

OTHER PUBLICATIONS

International Search Report and Written Opinion for Application PCT/FI2015/050669, dated May 13, 2016, 9 pages.

European Search Report for application EP 15784072.9, dated Jan. 17, 2020, 19 pages.

International Search Report and Written Opinion for application PCT/FI2015/050668, 10pages.

Russian Office Action for application 2018111257, dated Apr. 23, 2019, 7 pages.

Singapore Written Opinion for application SG 11201802308P, dated Aug. 8, 2019, 7 pages.

Chinese Office Action for application CN 201580083652.9, dated Jan. 6, 2020, 9 pages.

U.S. Non Final office Action U.S. Appl. No. 15/766,190, dated Mar. 3, 2020 , 23 pages.

2nd Chinese Office Action for Application No. 201580083652.9; dated Aug. 13, 2020; 12 Pages (with English Translation).

Xiuqiao, Huang; Handbook "Research and Practice of Sprinkler Irrigation Technology", Yellow River Waster Conservancy Press, Dec. 31, 2018, 3 Pages.

* cited by examiner

SUPPRESSION UNIT AND METHOD

BACKGROUND

Spraying apparatuses include a nozzle arranged to deliver a spray of fluidic material through discharge orifices to a surrounding environment, such as for fire-fighting. Some nozzles are received in fixed nozzle adapters and remain in the same position when utilized and not utilized. Such nozzles may be employed when discharge orifice protection is not required. Other nozzles are "pop out" nozzles that are arranged to move between passive and active states. The nozzle is positioned in a retracted position when in an inactive or passive state. In an active state, the nozzle is in an extended position such that at least one of the discharge orifices of the nozzle is exposed to deliver a spray of fluidic material.

The conventional pop-out nozzle is biased in the retracted position by a spring included with the nozzle construction. That is, the nozzle itself includes a shoulder that directly engages with the spring during activation. Under normal circumstances, the spring may not be exposed to moisture and therefore is presumably not at risk of corrosion due to moisture. However, when the nozzle is utilized, water or other fluid employed for firefighting passes towards the discharge orifices, also pressing the shoulder of the nozzle into engagement with the spring against its bias to expose the discharge orifices. Before the nozzle is moved completely to the extended position, fluid may exit the discharge orifices and enter the spring chamber, within which the spring is seated. If the nozzle is not utilized again for an extended period of time, which is common for fire spraying apparatuses, the spring is at risk of corrosion due to residual moisture within the spring chamber. A corroded spring may cause corrosion product accumulation in front of the piston which may jam the piston, or the spring may break over time due to the corrosion or may not retract, resulting in undesirable scenarios for successful operation of the suppression unit.

Further, when fire fighting spraying apparatuses are employed in certain environments, such as in a duct, the nozzles must be directed so as to cover an area with a predetermined amount of fire-fighting fluid. If discharge orifices are rotated in a manner that changes the amount of fluid a particular area receives, a system of units may not adequately serve the intended purpose.

Accordingly, there exists a need in the art for a spraying apparatus with a cost efficient, test-approved nozzle that can be maintained over extended periods of time and function to operate directionally as intended.

BRIEF DESCRIPTION

A suppression unit includes a nozzle, a casing, and a biasing device. The nozzle includes an exterior surface, an interior bore extending along a longitudinal axis, and a plurality of discharge orifices passing from the interior bore to the exterior surface. The casing includes an interior surface and an exterior surface. The nozzle is disposed within the casing. The discharge orifices are covered by the casing in a biased passive condition of the nozzle, and the discharge orifices are moved longitudinally out of the casing in an active condition of the nozzle. The biasing device is disposed in a spring chamber between the nozzle and the casing. The spring chamber is fluidically isolated from the nozzle in the active and passive conditions.

In addition to one or more of the features described above or below, or as an alternative, further embodiments could include the casing including at least one vent extending from the interior surface of the casing to the exterior surface of the casing.

In addition to one or more of the features described above or below, or as an alternative, further embodiments could include a filter disposed in the at least one vent.

In addition to one or more of the features described above or below, or as an alternative, further embodiments could include the spring chamber open to atmospheric pressure exterior of the suppression unit via the at least one vent.

In addition to one or more of the features described above or below, or as an alternative, further embodiments could include an actuator piston including an interior channel in fluid communication with the interior bore, the nozzle connected to the actuator piston, the actuator piston disposed within the casing, the spring chamber fluidically isolated from the interior channel.

In addition to one or more of the features described above or below, or as an alternative, further embodiments could include the actuator piston including an exterior surface having a first shoulder, and the interior surface of the casing including a second shoulder, a first end of the biasing device is operatively engaged with the first shoulder, and a second end of the biasing device is operatively engaged with the second shoulder.

In addition to one or more of the features described above or below, or as an alternative, further embodiments could include the interior surface of the casing further including a protrusion, and at least one vent extending from the interior surface of the casing to the exterior surface of the casing, the at least one vent disposed longitudinally between the protrusion and the second shoulder, and the first shoulder spaced from the protrusion in the passive condition and abutting the protrusion in the active condition.

In addition to one or more of the features described above or below, or as an alternative, further embodiments could include an inlet portion, the inlet portion having a fluid passageway in communication within the interior channel of the actuator piston and the interior bore of the nozzle, the inlet portion further comprising a receiving section, a first portion of the casing receivable within the receiving section.

In addition to one or more of the features described above or below, or as an alternative, further embodiments could include at least one vent extending from the interior surface of the casing to the exterior surface of the casing, and a flange extended from the exterior surface of the casing and operatively arranged for mounting the suppression unit on a surface, the flange disposed longitudinally between the at least one vent and the discharge orifices in at least the active condition of the nozzle.

In addition to one or more of the features described above or below, or as an alternative, further embodiments could include the nozzle including a first end and a longitudinally spaced second end, the suppression unit further including a rotation limitator secured to the second end of the nozzle, the rotation limitator limiting rotation of the nozzle with respect to the casing in at least the passive condition of the nozzle.

In addition to one or more of the features described above or below, or as an alternative, further embodiments could include the rotation limitator including a plate portion and a casing mating member extending at a non-zero angle from the plate portion, the casing including a casing mating member receiving area sized to receive the casing mating member.

In addition to one or more of the features described above or below, or as an alternative, further embodiments could include the casing mating member as a pin, and the casing mating member receiving area as an aperture.

In addition to one or more of the features described above or below, or as an alternative, further embodiments could include the casing mating member as a bent flange, and the casing mating member receiving area as a chamfered section of the casing.

In addition to one or more of the features described above or below, or as an alternative, further embodiments could include an O-ring seal between the casing and the nozzle, the seal longitudinally disposed between the spring chamber and the discharge orifices in both the active and passive conditions of the nozzle.

In addition to one or more of the features described above or below, or as an alternative, further embodiments could include the biasing device as a spring made of stainless steel.

A method of employing a nozzle within a suppression unit, the suppression unit including the nozzle having an exterior surface, an interior bore extending along a longitudinal axis, and a plurality of discharge orifices passing from the interior bore to the exterior surface; a casing having an interior surface and an exterior surface, the nozzle disposed within the casing, the discharge orifices covered by the casing in a biased passive condition of the nozzle, and the discharge orifices moved out of the casing in an active condition of the nozzle; and a biasing device disposed in a spring chamber between the nozzle and the casing, the method includes fluidically isolating the spring chamber from the nozzle in the active and passive conditions.

In addition to one or more of the features described above or below, or as an alternative, further embodiments could include venting the spring chamber through at least one vent extending from the interior surface of the casing to the exterior surface of the casing.

In addition to one or more of the features described above or below, or as an alternative, further embodiments could include mounting the suppression unit to a surface, wherein venting the spring chamber includes exposing the at least one vent to atmosphere on one side of the surface, and the discharge orifices are exposed to an atmosphere on an opposite side of the surface during the active condition of the nozzle.

In addition to one or more of the features described above or below, or as an alternative, further embodiments could include limiting rotation of the nozzle with respect to the casing using a rotation limitator attached to an end of the nozzle.

In addition to one or more of the features described above or below, or as an alternative, further embodiments could include aligning a bent flange of the rotation limitator with a chamfered section of the casing. In addition to one or more of the features described above or below, or as an alternative, further embodiments could include providing a pin of the rotation limitator within a pin hole in the casing.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
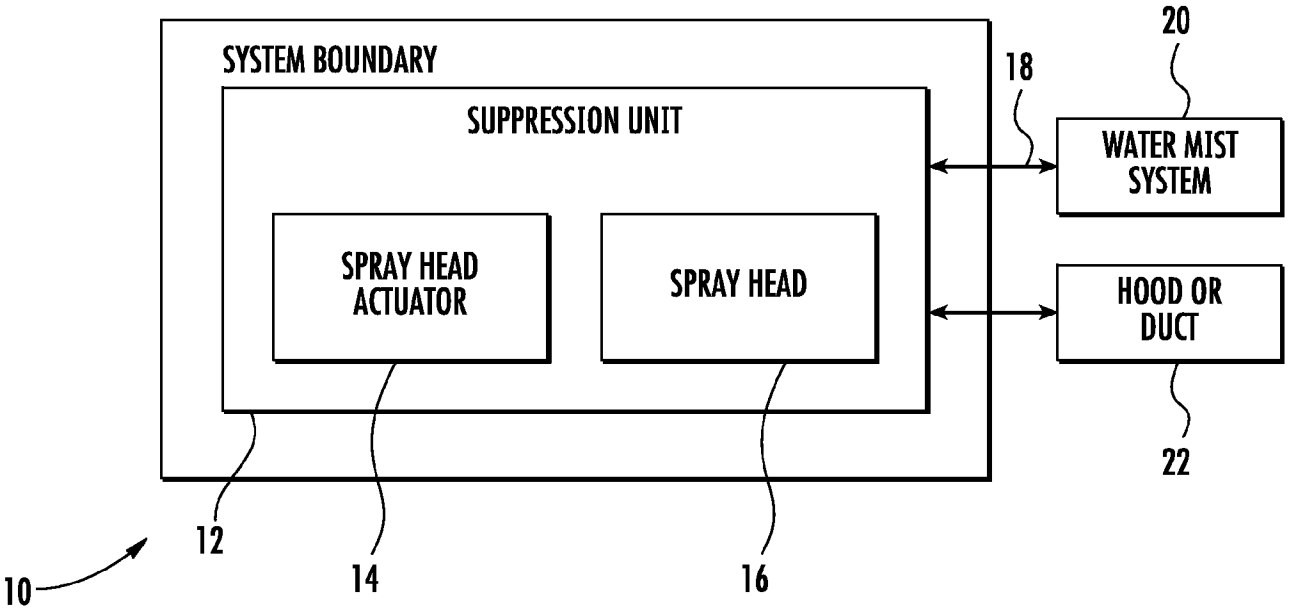
FIG. 1 is a block diagram of an embodiment of a suppression system.

FIG. 1 shows a block diagram of an embodiment of a fire suppression system 10. The system 10 includes a fire suppression unit 12 including an actuator piston 14 (a spray head actuator piston) and a nozzle 16 (a spray head). While connected to the actuator piston 14, the nozzle 16 is separable from the actuator piston 14 and thus the nozzle 16 can be fire tested and approved as a single component, or even utilized as a fixed, non-actuatable nozzle in other embodiments. The fire suppression unit 12 receives a fluid 18 for activating the actuator piston 14 to move the nozzle 16 from a retracted position (passive condition) to an extended position (active condition). In one embodiment, the fluid 18 is supplied by a water mist system 20. That is, the fluid 18 may be water which due to the high pressure is then atomized into water mist. However, the fluid 18 is not limited to water and water mist, but may additionally or alternatively include additives, foam agent, or any other suppression agent deemed suitable for the intended purpose. Also in one embodiment, the fire suppression system 10 is incorporable in a hood or duct 22, although other uses of the fire suppression system 10 are within the scope of these embodiments.

Figure 2:
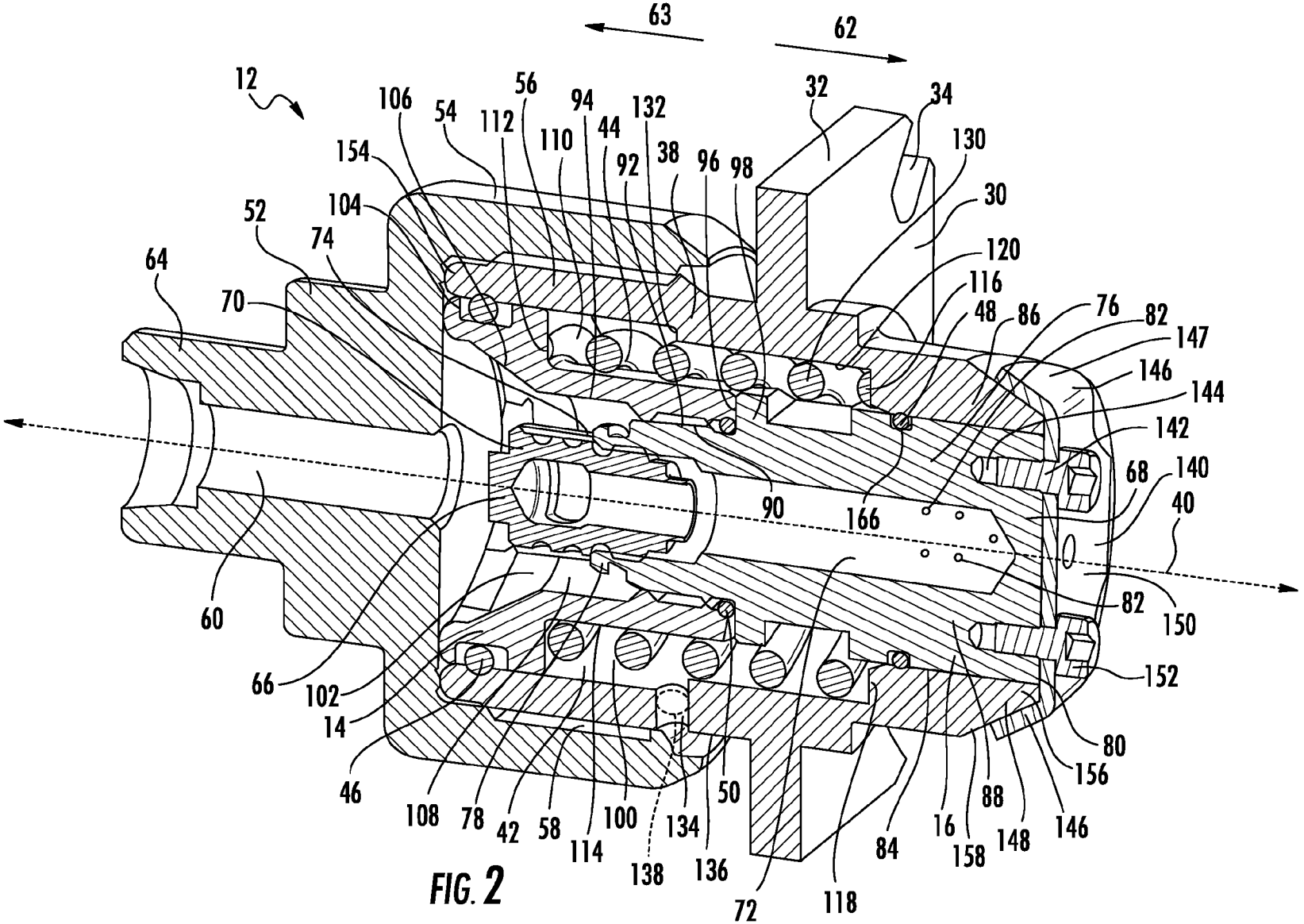
FIG. 2 is perspective sectional view of one embodiment of a suppression unit, depicted in a passive condition, for the suppression system of FIG. 1
Figure 3:
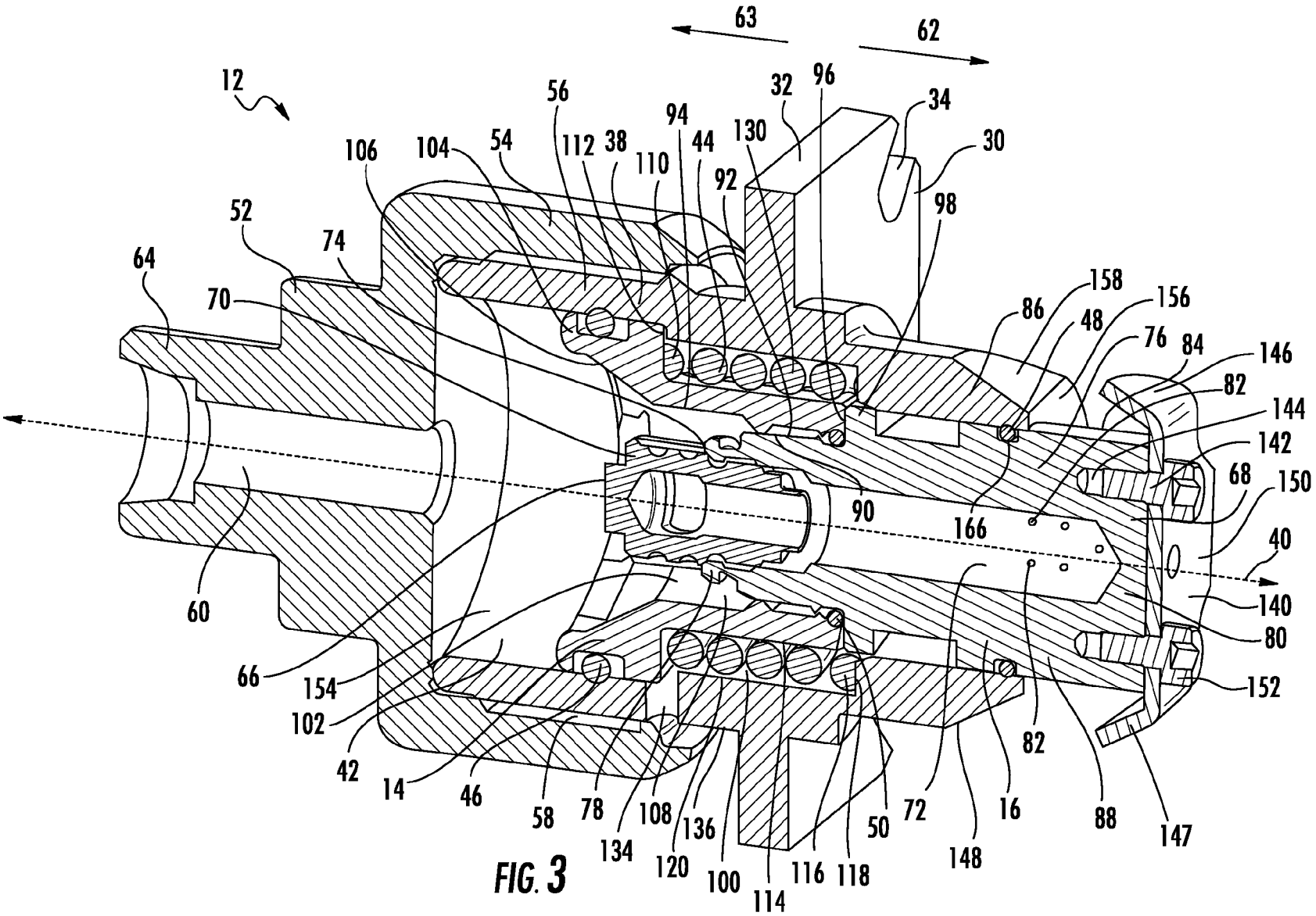
FIG. 3 is a perspective sectional view of the suppression unit, depicted in an active condition.
Figure 4:
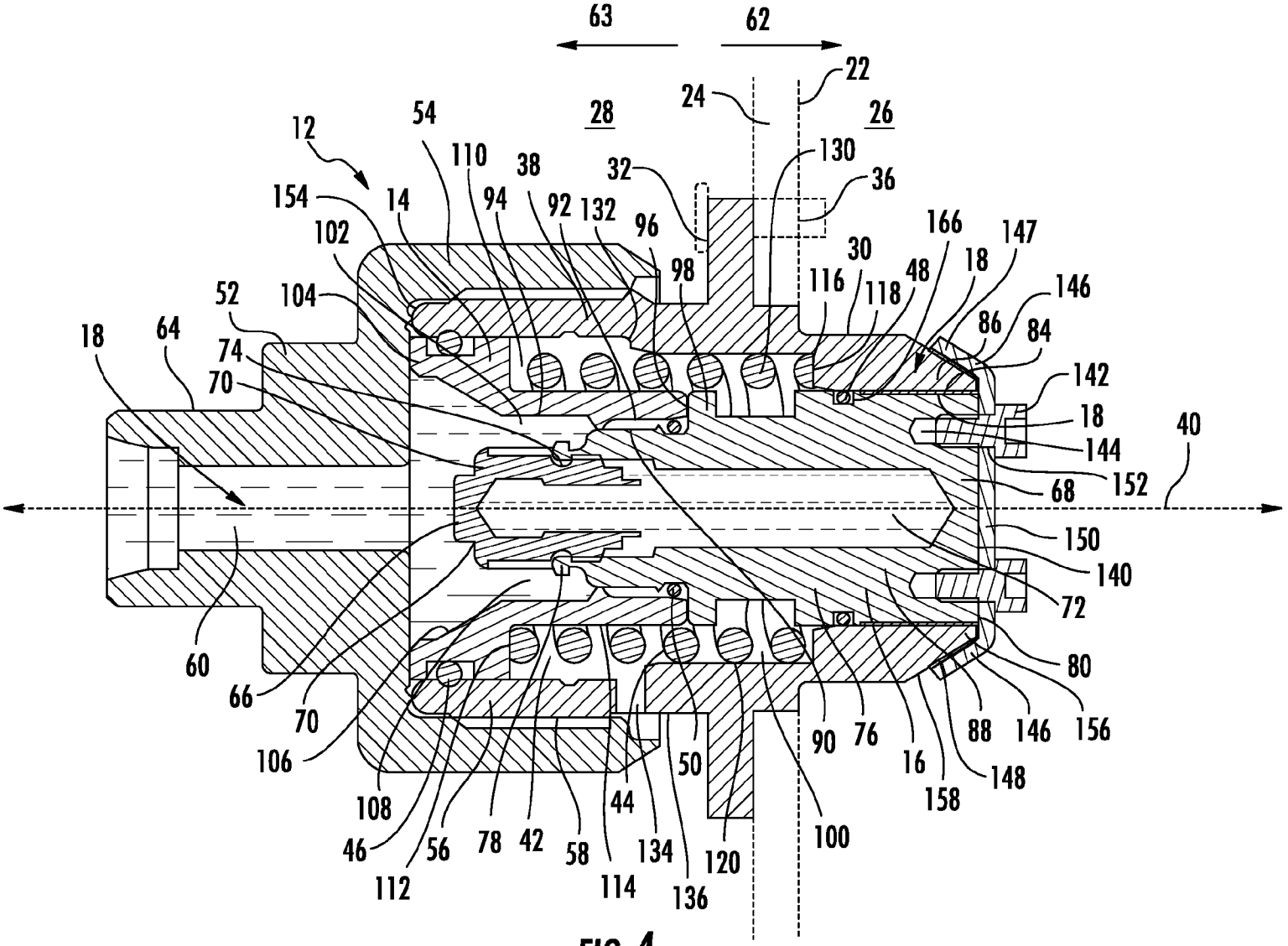
FIG. 4 is a side sectional view of the suppression unit, depicted in the passive condition with an introduction of fluid therein.
Figure 5:
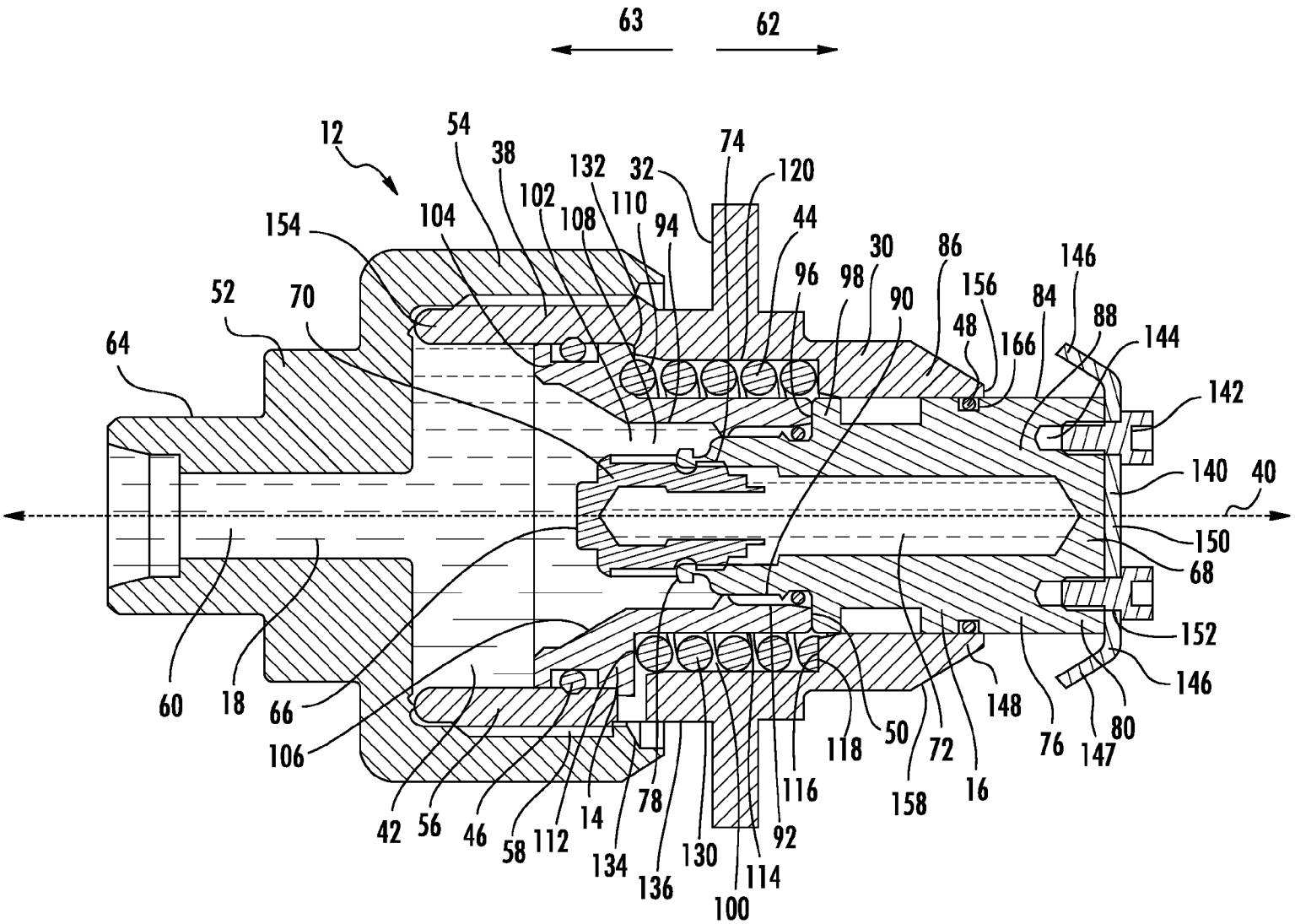
FIG. 5 is a side sectional view of the suppression unit, depicted in the active condition after the introduction of a fluid therein.
Figure 6:
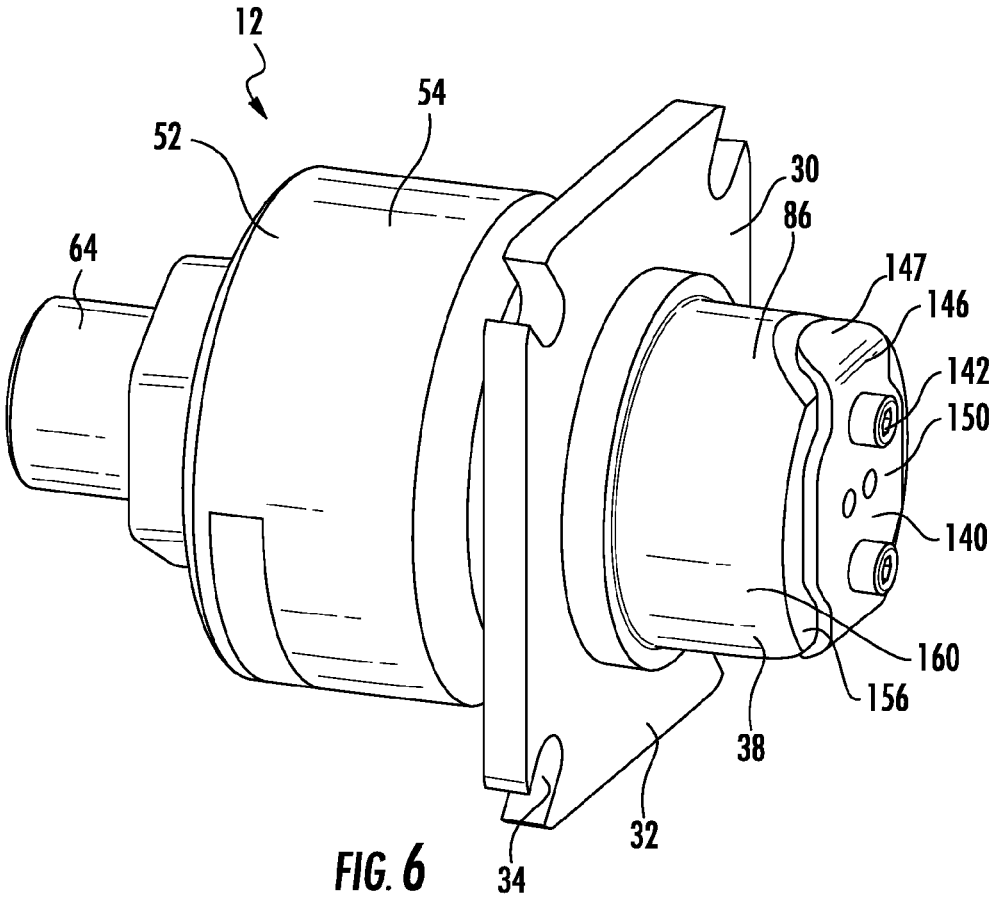
FIG. 6 is a perspective view of the suppression unit, depicted in the passive condition.
Figure 7:
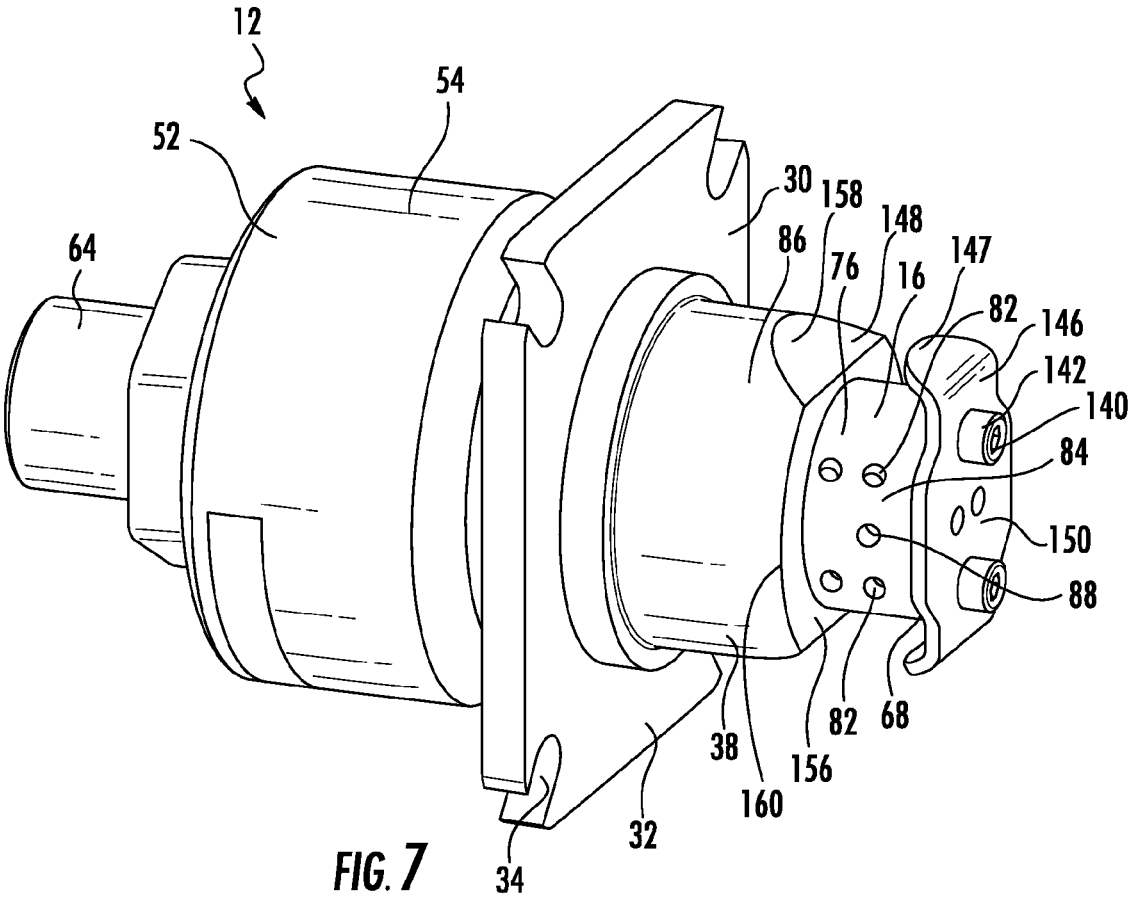
FIG. 7 is a perspective view of the suppression unit, depicted in the active condition; and, FIG. 8 is a side sectional view of another embodiment of a suppression unit, depicted in the passive condition, for the suppression system of FIG. 1.

FIGS. 2, 4, and 6 illustrate an embodiment of the fire suppression unit 12 in a passive or inactive condition with the nozzle 16 in a retracted position (the nozzle 16 hidden from view in FIG. 6), while FIGS. 3, 5, and 7 illustrate an embodiment of the fire suppression unit 12 in an active condition, with the nozzle 16 in an extended position. Under normal circumstances, such as in an environment without fire, the fire suppression unit 12 is in the passive condition shown in FIGS. 2, 4, and 6. As shown in FIG. 4, in one application of the fire suppression unit 12, the fire suppression unit 12 is mounted on a wall or surface 24 of the hood or duct 22, such as a galley duct of a marine vessel. The surface 24 separates a protected area 26, such as an interior of the duct 22, from an unprotected area 28, such as an exterior area of the duct 22. By "unprotected" it should be understood that while the area 28 is not protected by the suppression unit 12, the area 28 may be protected by other suppression units 12 or other devices not described herein. Also, the fire suppression unit 12 may be employed in other fields and applications other than marine galley ducts, such as, but not limited to, any industrial ventilation or material transport system, wood processing plants, coal power plants, bakeries, laundries (including marine laundry ducts), and anywhere air with small flammable particles is present and ventilated or transported using channels and air. Also, the protected area 26 may simply be a room, and the unprotected area 28 may be disposed behind a ceiling panel or wall. The surface 24 may thus represent any wall, panel or surface upon which the fire suppression unit 12 is mounted.

The nozzle 16 is movably supported relative to the surface 24 by a casing 30. The casing 30 includes a flange 32 having a plurality of securement receiving areas 34, such as grooves, holes, or apertures, for receiving a respective number of securement devices 36 (FIG. 4), such as screws, therethrough to secure the fire suppression unit 12 to the surface 24. The casing 30 further includes a body 38 having a longitudinal axis 40 and an interior main chamber 42 for receiving the nozzle 16 therein. Also received within the main chamber 42 is the actuator piston 14, which is also longitudinally movable within the casing 30, and biasing device 44, such as a compression spring 130, and in particular a stainless steel spring. An O-ring 46 may be disposed between the actuator piston 14 and the body 38, an O-ring 48 may be disposed between the nozzle 16 and the body 38, and an O-ring 50 may be disposed between the actuator piston 14 and the nozzle 16. An inlet portion 52 (otherwise referred to as a connection plug) is fixedly attached to the body 38. In one embodiment, the inlet portion 52 includes a body receiving section 54 concentrically surrounding a first portion 56 (an upstream portion) of the body 38, and thus may also be termed a "nut." The body receiving section 54 and the first portion 56 of the body 38 may include cooperating threads 58 for threadably engaging the body 38 within the inlet portion 52. The inlet portion 52 further includes a fluid passageway 60 defining a flow path for a fire suppression fluid 18 to pass in direction 62 from a fluid supply, such as water mist system 20 (FIG. 1), towards the actuator piston 14 and nozzle 16. The fluid passageway 60 may further extend along the longitudinal axis 40. The inlet portion 52 may include exterior threads 64 for connecting with a hose or pipe to connect to the fluid supply (such as water mist system 20).

The nozzle 16 includes a first end 66 and a second end 68. A filter 70 is positioned at the first end 66, and is operatively arranged to filter incoming fluid 18 from the fluid passageway 60 entering an interior bore 72 of the nozzle 16, such as through inlets 74, such as of a filter mesh. The filter 70 may include a filter plug covered with filter mesh as illustrated, however the filter 70 may be designed in an alternative matter to filter the flow of fluid into an interior bore 72. The nozzle 16 also includes a nozzle body 76 having a first end 78 and a second end 80 (corresponding to the second end 68 of the nozzle 16) and an interior bore 72, the interior bore 72 also extending along the longitudinal axis 40. Adjacent the second end 80 of the nozzle body 76 is at least one discharge orifice 82 that passes through the nozzle body 76 from the interior bore 72 to an exterior surface 84 of the nozzle body 76 (see FIG. 3). A plurality of discharge orifices 82 is illustrated, and is disposed in a discharge area 88 of the nozzle body 76. Thus, fluid 18 from the fluid passageway 60 enters the interior bore 72 via the inlets 74 and then exits the interior bore 72 via the discharge orifices 82.

As is evident from FIGS. 2, 4, and 6, fluid may not freely exit the discharge orifices 82 when the second end 68 of the nozzle 16, including the discharge area 88 of the nozzle body 76, is disposed within the main chamber 42 of the casing 30. In the passive condition shown in FIGS. 2, 4, and 6, a protection portion 86 of the casing 30 covers the discharge orifices 82. In one embodiment, an inner diameter of the protection portion 86 may be substantially the same as an outer diameter of the discharge area 88, such that the protection portion 86 forms a close fit sleeve/sheath that covers and protects the discharge orifices 82 in the passive condition. The discharge area 88 may thus, in one embodiment, be provided with a substantially constant outer diameter for this purpose.

Using fluid pressure, the actuator piston 14 moves the nozzle 16 from the passive condition shown in FIGS. 2, 4, and 6, to the active condition shown in FIGS. 3, 5, and 7. The actuator piston 14 receives the nozzle 16 therein, such as by threaded engagement between exterior threads 90 on the exterior surface 84 of the nozzle body 76 and interior threads 92 on an interior surface 94 of the actuator piston 14. A second end 96 of the actuator piston 14 may further abut with a shoulder 98 on the nozzle body 76 of the nozzle 16 for assisting in proper assembly between the actuator piston 14 and the nozzle 16. The shoulder 98 is a section of the nozzle body 76 that has a larger diameter than the section of the nozzle body 76 that includes the exterior threads 90. Due in part to the second end 96 in abutment with the shoulder 98, a spring chamber 100, in receipt of the biasing device 44, is separated from the interior bore 72 of the nozzle 16 and interior channel 102 of the actuator piston 14 by the actuator piston 14 and the nozzle 16. The O-ring 50 may be positioned between the second end 96 of the actuator piston 14 and the shoulder 98 of the nozzle 16. The O-ring 46 may be positioned between a first end 104 of the actuator piston 14 and the body 38 of the casing 30. The interior channel 102 of the actuator piston 14, in which the nozzle 16 is received, may include a frustoconical tapered portion 106 for guiding fluid towards the nozzle 16. An annular space 108 may further be disposed between the interior surface 94 of the actuator piston 14 and the filter 70. The annular space 108 ends at the threaded connection between exterior threads 90 and interior threads 92 between the actuator piston 14 and the nozzle 16. Fluid that wells up in the annular space 108 may then find way into the inlets 74 and the interior bore 72 of the nozzle body 76.

The spring chamber 100 between the body 38 of the casing 30 and the actuator piston 14/nozzle 16 encloses the biasing device 44, such as the illustrated spring 130, therein. The biasing device 44 includes a first end 110 that abuts with a shoulder 112 on an exterior surface 114 of the actuator piston 14, and a second end 116 that abuts with a shoulder 118 on an interior surface 120 of the body 38. The shoulder 118 on the interior surface 120 of the body 38 is disposed upstream of the discharge orifices 82, even in the passive condition, and thus the biasing device 44 is shielded from moisture from the discharge orifices 82, as well as shielded from moisture from the fluid passageway 60 of the inlet portion 52 and the interior channel 102 of the actuator piston 14. The shoulder 118 faces the shoulder 112. The shoulder 112 is spaced a first distance from the shoulder 118 in the passive condition shown in FIGS. 2, 4, 6, and the shoulder 112 moves closer to the shoulder 118 to be spaced a second distance smaller than the first distance in the active condition shown in FIGS. 3, 5, 7. As the casing 38 is fixedly supported on the wall 24, the actuator piston 14 is responsible for moving the shoulder 112 closer to the shoulder 118 and compressing the biasing device 44 therebetween. Thus, the actuator piston 14 serves as a piston within the suppression unit 12. Activation of the actuator piston 14 to compress the biasing device 44 occurs upon receipt of fluid pressure from the fluid passageway 60 of the inlet portion 52 into the interior channel 102 of the actuator piston 14. The increasing pressure within the interior channel 102 will force the actuator piston 14 in the direction 62, and force the nozzle 16 in direction 62. When the nozzle 16 is moved longitudinally to the extended position, the discharge orifices 82 are moved longitudinally past the protection portion 86 of the casing 30, and out of the casing 30. In this active condition, the discharge orifices 82 are fluidically communicable with the protected area 26. That is, the discharge orifices 82 are no longer protected by the body 38 of the casing 30. The O-ring 48 may remain within the protection portion 86 to retain the seal between the exterior surface 84 of the nozzle body 76 and the nozzle blocking protection portion 86 of the body 38 of the casing 30, such that fluid dispersed into protected area 26 is blocked from entry between the nozzle body 76 and the casing body 38. When the fluid pressure is removed, the reduced pressure on actuator piston 14 will allow the biasing device 44 to extend in direction 63 and push on shoulder 112 of the actuator piston 14 such that the actuator piston 14 will move in direction 63, thus retracting the nozzle 16 back within the casing 30.

To protect the biasing device 44 from moisture and possible corrosion that can result from moisture on the biasing device 44 over an extended period of time, in particular on a spring 130 formed of stainless steel or other metal, the spring chamber 100 is sealed from any possible fluid communication with the fluid passageway 60, the interior channel 102, and the interior bore 72. In one embodiment, the O-ring seal 48 seals the discharge orifices 82 from the spring chamber 100, the O-ring seal 46 seals the interior channel 102 from the spring chamber 100, and the O-ring seal 50 seals the intersection of the actuator piston 14 and the nozzle 16 from the spring chamber 100. As can be seen in FIGS. 2 and 4, when the suppression unit 12 is in the passive condition, the spring 130 in the spring chamber 100 is sealed from the interior bore 72, discharge orifices 82, interior channel 102, and fluid passageway 60. In particular reference to FIG. 4, any fluid 18 that may exit the discharge orifices 82 during the initial introduction of fluid 18 is prevented from entering the protected area 26 by the protection portion 86 of the casing 30, but is also prevented from entering the spring chamber 100 by the O-ring seal 48. When the nozzle 16 is moved in direction 62 by the actuator piston 14 under fluid pressure, as can be seen in FIGS. 3 and 5, the spring 130 in the spring chamber 100 is still sealed from the interior bore 72, discharge orifices 82, interior channel 102, and fluid passageway 60. In particular reference to FIG. 5, the fully extended nozzle 16 still retains the O-ring seal 48 within the casing 30 to ensure that the spring chamber 100 remains dry during the active condition. To stop the O-ring seal 48 from exiting the casing 30, a protrusion 132 protrudes radially inwardly from the interior surface 120 of body 38 of the casing 30. The protrusion 132 is disposed upstream of the shoulder 118 of the casing 30, but downstream of the shoulder 112 of the actuator piston 14. The shoulder 112 is spaced from the protrusion 132 in the passive condition shown in FIGS. 2 and 4, but abuts against the protrusion 132 during the active condition shown in FIGS. 3 and 5. The actuator piston 14, and thus the attached nozzle 16, is prevented from further movement in direction 62 due to the engagement of the shoulder 112 of the actuator piston 14 with the protrusion 132. Therefore, the O-ring seal 48 is retained within the casing 30 at all times during passive and active conditions of the suppression unit 12 to seal the spring chamber 100 from the wet environment in the protected area 26.

In one embodiment, the easing 30 may be provided with at least one vent 134 that fluidically communicates the spring chamber 100 with the area 28 (FIG. 4). Because the area 28 is dry, particularly as compared to area 26, which receives the fluid 18 during the active condition of the suppression unit 12, the spring chamber 100 is protected from fluid that passes through the suppression unit 12 and into the area 26. In one embodiment, the vent 134 is an aperture extending from the interior surface 120 of the body 38 of the casing 30 to an exterior surface 136 of the casing 30. While only one aperture is shown in FIGS. 2-7, the vent 134 may include a plurality of apertures (two vents 134 depicted in FIG. 8). The vent 134 may be generally disposed at or near the end of the threads 58, or between the threads 58 and the flange 32. The body receiving section 54 of the inlet portion 52 does not block the vent 134 on the exterior surface 136 of the casing 30, but the inlet portion 52 may be used to protect or shield the vent 134. Also, when the actuator piston 14 compresses the spring 130, the actuator piston 14 does not cover the vent 134. Thus, the vent 134 may provide the spring chamber 100 with fluidic communication to the environment outside of the casing 30, such as atmospheric pressure within area 28. When the actuator piston 14 compresses the spring 130, the spring chamber 100 will reduce in size, with the vent 34 providing fluidic communication to the area 28. In one embodiment, the vent 134 may include a filter 138 (FIG. 2), such as, but not limited to, a screen, for allowing fluidic communication between the spring chamber 100 and the area 28, but prohibiting entry of particles and debris into the spring chamber 100. By providing the vent 134 on an opposite side of the wall 24 than the discharge orifices 82, and by fluidically sealing the spring chamber 100 from the nozzle 16, the vent 134 remains on a dry side of the suppression unit 12. In another embodiment, in lieu of the vent 134, the spring chamber 100 may instead be dimensioned such that the enclosed space of the spring chamber 100 is used as an air spring. As air is compressed, the spring force is increased and stored energy is used to revert the actuator piston 14 to the passive condition upon reduction or removal of the fluid pressure.

In some embodiments, the delivery of fluid 18 into the protected area 26 must be designed to limit the fluid 18 to a particular zone and to overlap or not overlap with an adjacent zone so that the protected area 26 is adequately covered but not flooded by a system of units 12. The arrangement of the discharge orifices 82 about the discharge area 88 can be determined depending on the particular requirements of the protected area 26. Thus, in such embodiments where the intended alignment of the discharge orifices 82 with respect to the protected area 26 and surface 24 must be maintained, the suppression unit is provided with a rotation limitator 140. The rotation limitator 140 has a width greater than an outer circumference of the discharge area 88 of the nozzle 16 such that the rotation limitator 140 extends passed edges of the discharge area 88. The rotation limitator 140 is attached to the second end 80 of the nozzle body 76 of nozzle 16, such as by securement devices 142 received within receiving apertures 144 in the nozzle body 76. While two securement devices 142 are illustrated, any number of securement devices 142 may be utilized, as well as other means for retaining the rotation limitator 140 to the nozzle 16, as long as the discharge orifices 82 are not interrupted or blocked. The rotation limitator 140 shown in FIGS. 2-7 includes a plate portion 150 attached to the second end 80 of the nozzle body 76 of the nozzle 16 such that the rotation limitator 140 is not rotatable with respect to the nozzle 16. In an embodiment where the rotation limitator 140 is secured to the nozzle 16 using securement devices 142, the plate portion 150 may include apertures 152 alignable with the apertures 144 for passing the securement devices 142 therethrough. Protruding at a non-zero angle from the plate portion 150 is at least one casing mating member 146 that cooperates with a mating member receiving area 148 in the body 38 of the casing 30 to prevent the nozzle 16 from rotating with respect to the body 38 in at least the passive condition of the suppression unit 12. In one embodiment, the casing 30 includes a first end 154 (within the body receiving section 54 of the inlet portion 52) and a second end 156 adjacent the second end 80 of the nozzle body 76 when the nozzle 16 is fully retracted in the passive condition. In the embodiment shown in FIGS. 2-7, the mating member receiving area 148 is a chamfered section 158 of the second end 156 of the casing 30. The illustrated embodiment includes two diametrically opposed chamfered sections 158, although a different number of spaced apart chamfered sections 158 may be provided, including a solitary chamfered section 158. As shown in FIGS. 6 and 7, the second end 156 of the casing 30 also includes a corresponding number of non-chamfered sections 160 separated by the chamfered sections 158. When the suppression unit 12 is in the passive condition, the casing mating member 146 mates with the casing mating member receiving area 148 such that the rotation limitator 140 and the attached nozzle 16 are not rotatable about the longitudinal axis 40 due to the interference of the casing mating member 146 with the non-chamfered section 160.

Figure 8:
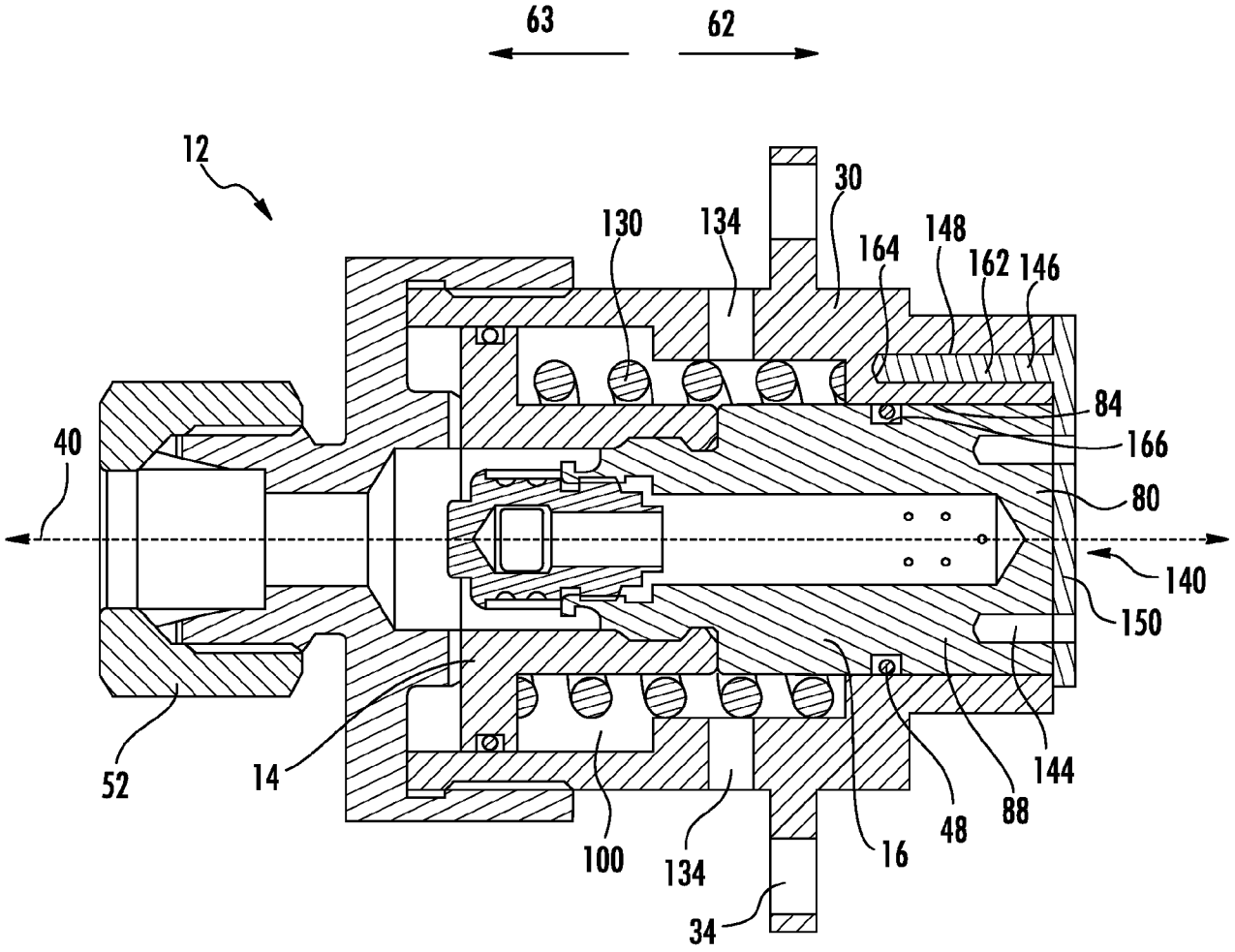

In another embodiment, as shown in FIG. 8, in lieu of the bent flange 147, the casing mating member 146 of the rotation limitator 140 includes a pin 162 receivable within pin hole 164 in the casing 30. The pin 162 extends at least substantially perpendicularly from the plate portion 150. The pin hole 164 and the pin 162 extend substantially parallel to the longitudinal axis 40 such that the nozzle 16 is movable in directions 62 and 63, with the pin 162 sliding within the pin hole 164. The pin 162 thus restricts the nozzle 16 from rotating about the longitudinal axis 40 in both the passive and the active conditions of the suppression unit 12. While only one pin 162 and pin hole 164 are shown, a plurality of pins 162 and corresponding pin holes 164 may be utilized. Further, if only rotation restriction in the passive condition is needed, the pin 162 may extend less than a length of the discharge area 88, such that the pin 162 is free from the pin hole 164 in the active condition of the suppression unit 12.

In addition to providing rotation limitation of the nozzle 16 with respect to the casing 30, the rotation limitator 140 is advantageously disposed at the second end 80 of the nozzle body 76, rather than integrated upstream of the second end 80. Thus, the exterior surface 84 of the nozzle body 76 can incorporate a cylindrical surface for including an O-ring receiving area 166 to hold the O-ring 48 therein between the nozzle 16 and the casing 30. The rotation limitator 140 therefore enables the suppression unit 12 to be divided into separate sealed dry and wet sections, with the spring 130 disposed within the dry section (spring chamber 100).

While previously a nozzle and piston have been manufactured as one part, in the embodiments described herein the nozzle 16 can be manufactured independently from the actuator piston 14. Due to the exterior threads 90 provided on the nozzle 16, the nozzle 16 can be independently utilized in different applications, such as a stand-alone nozzle not requiring extension and retraction (i.e., without the casing 30 and actuator piston 14), and thus the nozzle 16 can be independently tested as a nozzle. Also, when the nozzle 16 is employed in suppression unit 12, when features and/or dimensions of the actuator piston 14 and/or casing 30 are altered to suit different applications, the design and dimensions of the nozzle 16 need not be altered, thus reducing the complexity of the nozzle component. As long as the nozzle 16 remains the same, additional expensive and time consuming testing procedures on the nozzle 16 may be eliminated. The nozzle 16 thus serves as a modular component usable in a variety of suppression units 12, as well as a stand-alone unit. That is, the construction allows use of the type approved nozzle 16 with the actuator piston 14 in the suppression unit 12, and allows use of the type approved nozzle 16 as an independent spray head in conventional applications where protection of the discharge orifices 82 is not required. From a manufacturer perspective, it is beneficial to have a single type approved component instead of two. Further, because the nozzle 16 does not include the biasing device 44 in its construction, the nozzle 16 can be separately tested in tests limited to a nozzle.

Additionally, with separate sealed spring chamber 100 for the spring 130 on a dry side of the suppression unit 12, reliability of the suppression unit 12 is increased, as compared to units that allow moisture within a spring chamber. Even if one or more of the O-ring seals 46, 48, 50 are damaged, the potential for fluid 18 to enter the spring chamber 100 is extremely limited due to the placement of the protection portion 86 of the casing 30 adjacent the discharge orifices 82 of the nozzle 16 in the passive condition. The addition of a rotation limitator 140 does not adversely affect the ability to maintain the spring chamber 100 as a dry area.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A suppression unit comprising:

a nozzle having an exterior surface, an interior bore extending along a longitudinal axis, and a plurality of discharge orifices passing from the interior bore to the exterior surface;

a casing having an interior surface and an exterior surface, the nozzle disposed within the casing, the discharge orifices covered by the casing in a biased passive condition of the nozzle, and the discharge orifices moved longitudinally out of the casing in an active condition of the nozzle;

a biasing device disposed in a spring chamber between the nozzle and the casing;

an actuator piston including an interior channel in fluid communication with the interior bore, the nozzle connected to the actuator piston, the actuator piston disposed within the casing, wherein the spring chamber is fluidically isolated from the interior channel;

wherein the actuator piston includes an exterior surface having a first shoulder, and the interior surface of the casing includes a second shoulder, a first end of the biasing device is operatively engaged with the first shoulder, and a second end of the biasing device is operatively engaged with the second shoulder;

wherein the interior surface of the casing further includes a protrusion, and at least one vent extending from the interior surface of the casing to the exterior surface of the casing, the at least one vent disposed longitudinally between the protrusion and the second shoulder, and wherein the first shoulder is spaced from the protrusion in the passive condition and abuts the protrusion in the active condition.

2. The suppression unit according to claim 1, further comprising an inlet portion, the inlet portion having a fluid passageway in communication within the interior channel of the actuator piston and the interior bore of the nozzle, the inlet portion further comprising a receiving section, a first portion of the casing receivable within the receiving section.

3. The suppression unit according to claim 1, wherein the nozzle includes a first end and a longitudinally spaced second end, the suppression unit further comprising a rotation limitator secured to the second end of the nozzle, the rotation limitator limiting rotation of the nozzle with respect to the casing in at least the passive condition of the nozzle.

4. The suppression unit according to claim 3, wherein the rotation limitator includes a plate portion and a casing mating member extending at a non-zero angle from the plate portion, the casing including a casing mating member receiving area sized to receive the casing mating member.

5. The suppression unit according to claim 4, wherein the casing mating member is a pin, and the casing mating member receiving area is an aperture.

6. The suppression unit according to claim 1, further comprising an O-ring seal between the casing and the nozzle, the seal longitudinally disposed between the spring chamber and the discharge orifices in both the active and passive conditions of the nozzle.

7. The suppression unit according to claim 1, wherein the biasing device is a spring made of stainless steel.

8. A suppression unit comprising:

a nozzle having an exterior surface, an interior bore extending along a longitudinal axis, and a plurality of discharge orifices passing from the interior bore to the exterior surface;

a casing having an interior surface and an exterior surface, the nozzle disposed within the casing, the discharge orifices covered by the casing in a biased passive condition of the nozzle, and the discharge orifices moved longitudinally out of the casing in an active condition of the nozzle;

a biasing device disposed in a spring chamber between the nozzle and the casing;

an actuator piston including an interior channel in fluid communication with the interior bore, the nozzle connected to the actuator piston, the actuator piston disposed within the casing, wherein the spring chamber is fluidically isolated from the interior channel;

wherein the nozzle includes a first end and a longitudinally spaced second end, the suppression unit further comprising a rotation limitator secured to the second end of the nozzle, the rotation limitator limiting rotation of the nozzle with respect to the casing in at least the passive condition of the nozzle;

wherein the rotation limitator includes a plate portion and a casing mating member extending at a non-zero angle from the plate portion, the casing including a casing mating member receiving area sized to receive the casing mating member;

wherein the casing mating member is a bent flange, and the casing mating member receiving area is a chamfered section of the casing.

9. The suppression unit according to claim 8, wherein the casing includes at least one vent extending from the interior surface of the casing to the exterior surface of the casing.

10. The suppression unit according to claim 9, further comprising a filter disposed in the at least one vent.

11. The suppression unit according to claim 9, wherein the spring chamber is open to atmospheric pressure exterior of the suppression unit via the at least one vent.

12. The suppression unit according to claim 8, wherein the actuator piston includes an exterior surface having a first shoulder, and the interior surface of the casing includes a second shoulder, a first end of the biasing device is operatively engaged with the first shoulder, and a second end of the biasing device is operatively engaged with the second shoulder.

13. The suppression unit according to claim 8, wherein the casing further includes at least one vent extending from the interior surface of the casing to the exterior surface of the casing, the flange disposed longitudinally between the at least one vent and the discharge orifices in at least the active condition of the nozzle.

* * * * *